US008934821B2

(12) United States Patent
Kubo et al.

(10) Patent No.: US 8,934,821 B2
(45) Date of Patent: Jan. 13, 2015

(54) BELT FOR AN IMAGE FORMING APPARATUS, AND IMAGE FORMING APPARATUS

(71) Applicants: Hidetaka Kubo, Kanagawa (JP); Jun Aoto, Kanagawa (JP); Kenichi Mashiko, Shizuoka (JP); Sayaka Katoh, Kanagawa (JP); Daisuke Aoki, Kanagawa (JP)

(72) Inventors: Hidetaka Kubo, Kanagawa (JP); Jun Aoto, Kanagawa (JP); Kenichi Mashiko, Shizuoka (JP); Sayaka Katoh, Kanagawa (JP); Daisuke Aoki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/677,599

(22) Filed: Nov. 15, 2012

(65) Prior Publication Data

US 2013/0129395 A1 May 23, 2013

(30) Foreign Application Priority Data

Nov. 17, 2011 (JP) ..... 2011-251383

(51) Int. Cl.
*G03G 15/01* (2006.01)
*G03G 15/16* (2006.01)

(52) U.S. Cl.
CPC ..... *G03G 15/1605* (2013.01); *G03G 15/162* (2013.01)
USPC ..... 399/302

(58) Field of Classification Search
CPC ..... G03G 15/162; G03G 15/1605
See application file for complete search history.

(56) References Cited

U.S. PATENT DOCUMENTS

| | | | | |
|---|---|---|---|---|
| 5,666,193 | A * | 9/1997 | Rimai et al. | 430/47.2 |
| 6,217,471 | B1 * | 4/2001 | Brandsma et al. | 474/242 |
| 2007/0023156 | A1 * | 2/2007 | Hikita et al. | 162/358.1 |
| 2008/0003030 | A1 * | 1/2008 | Aze et al. | 399/333 |
| 2009/0050283 | A1 * | 2/2009 | Hikida | 162/358.1 |
| 2011/0177238 | A1 * | 7/2011 | Aoto et al. | 427/152 |
| 2013/0004212 | A1 * | 1/2013 | Kubo et al. | 399/302 |
| 2013/0251420 | A1 * | 9/2013 | Okabe et al. | 399/329 |

FOREIGN PATENT DOCUMENTS

| | | |
|---|---|---|
| JP | 9-230717 | 9/1997 |
| JP | 2000-293045 | 10/2000 |
| JP | 2007-83424 | 4/2007 |
| JP | 4430892 | 12/2009 |

* cited by examiner

*Primary Examiner* — Walter L Lindsay, Jr.
*Assistant Examiner* — Arlene Heredia Ocasio
(74) *Attorney, Agent, or Firm* — Cooper & Dunham LLP

(57) ABSTRACT

To provide a belt for an image forming apparatus, which contains: a base layer; an elastic layer; and spherical particles, wherein the belt for an image forming apparatus is provided across a plurality of rollers of the image forming apparatus to rotate, wherein the belt for an image forming apparatus has a laminate structure where at least the base layer and the elastic layer are provided in this order, wherein the spherical particles are partially embedded in an exposed surface of the elastic layer, and wherein, relative to a width direction of the belt for an image forming apparatus, a thickness of an edge portion of the belt for an image forming apparatus is 50% to 95% of a thickness of a center portion of the belt for an image forming apparatus, and an edge curling amount of the belt is 4 mm or less.

9 Claims, 5 Drawing Sheets

BELT FOR AN IMAGE FORMING APPARATUS, AND IMAGE FORMING APPARATUS

BACKGROUND OF THE INVENTION

1. Field of the Invention

The present invention relates to a belt for an image forming apparatus, which is mounted in an image forming apparatus, such as a photocopying machine, and a printer, and relates to an image forming apparatus using the belt.

2. Description of the Related Art

Conventionally, a seamless belt has been used as a member of an electrophotographic device for various uses. Especially, recent full-color electrophotographic devices employ an intermediate transfer belt system, in which developed images of four colors, yellow, magenta, cyan, and black, are superimposed on an intermediate transfer member temporarily, followed by being collectively transferred onto a transfer medium, such as paper.

As for the aforementioned intermediate transfer belt, a system using developing units of four respective colors to one photoconductor has been used, but this system has a problem that a printing speed thereof is slow. Accordingly, to achieve high speed printing, a quadruple-tandem system has been used, where the tandem system includes providing photoconductors of four respective colors, and an image of each color is continuously transferred to paper. In this system, however, it is very difficult to accurately position images of colors to be superimposed, because the position of paper changes as affected by the environment, which causing displacement of the colors in the image. Accordingly, currently, an intermediate transfer belt system has been mainly adapted for the quadruple-tandem system.

Under the circumstances as mentioned above, the higher requirements for properties (high speed transferring, and accuracy for positioning) of an intermediate transfer belt have been demanded than before, and therefore it is necessary for an intermediate transfer belt to satisfy these requirements. Especially for the accuracy for positioning, it has been required to inhibit variations caused by deformation of an intermediate transfer belt itself, such as stretching, after continuous use thereof. Moreover, an intermediate transfer belt is desired to have flame resistance as it is provided over a wide region of a device, and high voltage is applied thereto for transferring. To satisfy these demands, a polyimide resin, polyamide imide resin, or the like, that is a highly elastic and highly heat resistant resin, has been mainly used as a material of an intermediate transfer belt (base layer).

An intermediate transfer belt formed of a polyimide resin is however has high surface hardness, as the resin constituting the belt has high hardness. When a toner image is transferred, therefore, high pressure is applied to a toner layer. As a result, the toner is partially aggregated, and formation of so-called a partially-missing image, where part of an image is not transferred, may be caused. Moreover, the intermediate transfer belt having high hardness has inferior correspondence to a member to be in contact in a transferring section, such as with a photoconductor or a sheet. Accordingly, a contact failed area (void) may be partially caused in the transferring section, causing transfer unevenness.

In addition, there have been recently more occasions that images are formed on various types of a sheet in a full-color electrophotographic system. Not only a general smooth sheet, various sheets from a sheet of high smoothness with slippery surface, such as coated paper to a sheet having surface roughness, such as recycle paper, embossed paper, Japanese paper, and Kraft paper, have been often used. It is important that an intermediate transfer belt has correspondence to sheets of these different surface configurations. If the intermediate transfer belt has insufficient correspondence, unevenness in density and color tone corresponded to the convexo-concave surface configurations of the sheet appears in the resulting image. To solve this problem, various intermediate transfer belts have been proposed to laminate a relatively flexible rubber elastic layer onto a base layer. Such rubber elastic layer however has greater thermal shrinkage than the base layer, which causes a problem that the belt tends to curve outward (to the side of the elastic layer).

Hitherto proposed was to coat an elastic layer provided on a transfer roller, not an intermediate transfer belt, with beads having diameters of 3 μm or smaller (see Japanese Patent Application Laid-Open (JP-A) No. 09-230717). When this structure is applied to a belt, however, the resulting belt has poor durability, and causes detachment of the particles, and running failures due to the edge curving of the belt. Therefore, such modification of the belt is not sufficient to solve the aforementioned problem.

Moreover, proposed has been to fix edge portions of an intermediate transfer belt to reduce edge curving (see JP-A No. 2000-293045). This technique is, however to press the curved edge externally by bonding with a tensile strength tape, rather than preventing occurrence of edge curling itself. A belt of this structure does not have sufficient durability required for use in current electrophotographic devices.

Further, proposed has been to increase a thickness of an edge portion of an intermediate transfer belt compared to a thickness of a center portion thereof (see JP-A No. 200783424). In the case where a thickness difference is made in a relatively hard material, such as a base material formed of a polyimide resin, transfer unevenness tends to occur, or an edge of the belt tends to be torn.

The present inventors have disclosed a cylindrical intermediate belt transfer member containing a belt base, a binder layer, and a particle layer (see Japanese Patent (JP-B) No. 4430892). However, this technique is not necessarily for disclosing a certain technical solution for preventing both edge curling of the belt with respect to the width to direction of the belt.

SUMMARY OF THE INVENTION

The present invention is to solve the aforementioned problems in the conventional art, and aims to provide a belt for an image forming apparatus that realizes excellent transferring property regardless of types and surface configurations of a transfer medium, gives excellent image quality, and has high durability without causing running failures due to curling of edges of the belt over a long period.

The present inventors have diligently conducted studies to achieve the aforementioned objects, and have found that the following belt for an image forming apparatus solves the aforementioned problems. Namely, the belt for an image forming apparatus contains: a base layer; an elastic layer; and spherical particles, wherein the belt for an image forming apparatus is provided across a plurality of rollers of the image forming apparatus to rotate, wherein the belt for an image forming apparatus has a laminate structure where at least the base layer and the elastic layer are provided in this order, wherein the spherical particles are partially embedded in an exposed surface of the elastic layer, and wherein, relative to a width direction of the belt for an image forming apparatus, a thickness of an edge portion of the belt for an image forming apparatus is 50% to 95% of a thickness of a center portion of the belt for an image forming apparatus, and an edge curling amount of the belt is 4 mm or less.

The present invention has been accomplished based upon the insights of the present inventors, and the means for solving the aforementioned problem are as follows:

The belt for an image forming apparatus of the present invention contains:

a base layer;

an elastic layer; and spherical particles, wherein the belt for an image forming apparatus is provided across a plurality of rollers of the image forming apparatus to rotate, wherein the belt for an image forming apparatus has a laminate structure where at least the base layer and the elastic layer are provided in this order, wherein the spherical particles are partially embedded in an exposed surface of the elastic layer, and wherein, relative to a width direction of the belt for an image forming apparatus, a thickness of an edge portion of the belt for an image forming apparatus is 50% to 95% of a thickness of a center portion of the belt for an image forming apparatus, and an edge curling amount of the belt is 4 mm or less.

The present invention can provide a belt for an image forming apparatus that exhibits excellent transferring property regardless of types and surface configurations of a transfer medium, gives excellent image quality, and has high durability without causing running failures due to curling of edges of the belt over a long period.

DETAILED DESCRIPTION OF THE INVENTION (Belt for Image Forming Apparatus)

The belt for an image forming apparatus (may be simply referred to as "belt" hereinafter) is a belt for an image forming apparatus, which is provided across a plurality of roller members to rotate, and the belt of the present invention contains at least a base layer, an elastic layer, and spherical particles, and may further contain other members, if necessary, The belt for an image forming apparatus has a laminate structure where at least the base layer and the elastic layer are provided in this order, and the spherical particles are partially embedded in an exposed surface of the elastic layer. Relative to a width direction of the belt for an image forming apparatus, a thickness of an edge portion of the belt for an image forming apparatus is 50% to 95% of a thickness of a center portion of the belt for an image forming apparatus, and an edge curling amount of the belt is 4 mm or less.

The belt for an image forming apparatus is preferably a seamless belt.

Belts are used for some members of an electrophotographic device, but there is an intermediate transfer member (an intermediate transfer belt) as an important member required to have electronic properties, for which a seamless belt is preferably used.

The belt of the present invention will be explained hereinafter.

The belt is not particularly limited as long as it is an belt for an image forming apparatus to be provided across a plurality of roller members to rotate, and can be used as a belt for any member depending on the intended purpose. However, the belt of the present invention is preferably mounted as an intermediate transfer belt in an electrophotographic device of an intermediate transfer belt system, that is a device of a system where a plurality of color toner developed images successively formed on an image bearing member (e.g., photoconductor drum) are successively superimposed on an intermediate transfer belt to carry out primary transfer, and the primary transferred images are collectively transferred onto a recording medium to carry out secondary transfer.

Figure 1:
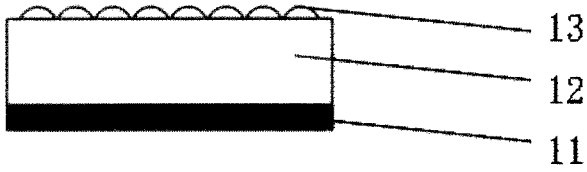
FIG. 1 is a diagram illustrating one example of a layer structure of the belt for an image forming apparatus of the present invention.

FIG. 1 depicts a layer structure of an intermediate transfer belt, which is suitably used in the present invention. The structure include a relatively bendable rigid base layer (11), a flexible elastic layer (12) laminated on the base layer (11), and at an outermost surface, spherical particles (13) are each separately aligned on the elastic layer (12) along its plane direction (spherical particles are embedded in the state where a top part of each particle is exposed) and are uniformly laminated in the convex-concave shape. The spherical particles (13) for use in the present invention are rarely superimposed each other in a thickness direction of the elastic layer, or rarely embedded completely inside the elastic layer (12).

<Base Layer>

First, a base layer (11) will be explained.

The base layer contains at least a resin, and an electrical resistance controlling agent, and may further contain other components, such as a dispersion aid, a reinforcing agent, a lubricant, a heat conducting material, and an antioxidant, if necessary.

<<Resin>>

The resin is appropriately selected depending on the intended purpose without any limitation, but for example, a fluororesin (e.g., PVDF, and ETFE), a polyimide resin, and a polyamide imide resin are preferable in view of stability in size, durability, mold-releasing property, and flame resistance, and a polyimide resin and a polyamide imide resin are particularly preferable in view of their mechanical strength (high elasticity) and thermal resistance.

<<Electrical Resistance Controlling Agent>>

The electrical resistance controlling agent is filler (or an additive) for adjusting electrical resistance of the resin. The electrical resistance controlling agent is appropriately selected depending on the intended purpose without any limitation, and examples thereof include metal oxide, carbon black, an ion conductive agent, and an electric conductive polymer material. These may be used alone, or in combination.

Examples of the metal oxide include zinc oxide, tin oxide, titanium oxide, zirconium oxide, aluminum oxide, and silicon oxide. Other examples thereof include products obtained by subjecting the above meal oxide to a surface treatment for improving dispersibility thereof.

Examples of the carbon black include ketjen black, furnace black, acetylene black, thermal black and gas black.

Examples of the ion conductive agent include a tetraalkyl ammonium salt, a trialkylbenzyl ammonium salt, an alkylsulfonic acid salt, an alkylbenzenesulfonic acid salt, alkylsulfate, glycerin fatty acid ester, sorbitan fatty acid ester, polyoxyethylenealkylamine, ester of polyoxyethylenealiphatic alcohol, alkyl betaine, and lithium perchlorate.

Examples of the electric conductive polymer material include polyaniline, polypyrrole, polysulfone, polyacetylene, and polythiophene.

Moreover, a coating liquid containing at least a resin component, which is used for production of the aforementioned seamless belt, may further contain additives, such as a dispersion aid, a reinforcing agent, a lubricant, a heat conducting material, and an antioxidant, if necessary.

The electric resistance of the base layer is appropriately selected depending on the intended purpose without any limitation. In the case where the belt is used as a seamless belt suitably equipped as an intermediate transfer belt, the electric resistance thereof is preferably $1\times10^{8}\Omega/\square$ to $1\times10^{13}\Omega/\square$ in the surface resistance, and $1\times10^{8}\ \Omega\cdot$cm to $1\times10^{11}\ \Omega\cdot$cm in the volume resistance. It is preferred that the base layer contain the electrical resistance controlling agent, such as carbon black, to achieve such electric resistance. Considering the mechanical strength of the base layer, it is preferred that the electrical resistance controlling agent be selected from those capable of achieving an amount for use with which the film of the base layer will not become brittle or easy to break. In the case where the belt is an intermediate transfer belt, it is preferred that a seamless belt having a desired balance of electric property (surface resistance and volume resistance) and mechanical strength be produced using a coating liquid in which blending of the resin component (e.g. polyimide resin precursor, and polyamide imide resin precursor) and the electrical resistance controlling agent is appropriately adjusted.

The elastic modulus of the base layer is appropriately selected depending on the intended purpose without any limitation, but it is preferably 2,000 MPa to 8,000 MPa, more preferably 3,000 MPa to 7,000 MPa. The elastic modulus can be measured by a method specified in JIS-K7127.

A thickness of the base layer is appropriately selected depending on the intended purpose without any limitation, but it is preferably 30 μm to 150 μm, more preferably 40 μm to 120 μm, and even more preferably 50 μm to 80 μm. When the thickness of the base layer is less than 30 μm, the belt tends to be cracked and then torn. When the thickness thereof is more than 150 μm, the belt may be cracked by bending. When the thickness of the base layer is within the aforementioned even more preferable range, it is advantageous in terms of durability. It is preferred that the base layer have hardly any unevenness in its thickness to enhance its running stability.

A method for measuring the thickness of the base layer is appropriately selected depending on the intended purpose without any limitation, and examples thereof include a method for measuring the thickness thereof by means of a contact-type or eddy current type thickness tester, and a method for measuring a cross-section of the film with a scanning electron microscope (SEM).

An amount of the electrical resistance controlling agent is appropriately selected depending on the intended purpose without any limitation. In the case where the electrical resistance controlling agent is carbon black, the amount thereof is preferably 10% by mass to 25% by mass, more preferably 15% by mass to 20% by mass, relative to the total solid content of the coating liquid. In the case where the electrical resistance controlling agent is metal oxide, the amount thereof is preferably 1% by mass to 50% by mass, more preferably 10% by mass to 30% by mass, relative to the total solid content of the coating liquid. When the amounts of the electrical resistance controlling agents are smaller than the aforementioned lower limits respectively, it is difficult to attain evenness in the resistance, and therefore there is a significant variation with respect to arbitral potential. When the amounts of the electrical resistance controlling agents are greater than the aforementioned upper limits respectively, the mechanical strength of the intermediate transfer belt reduces, which is not preferable on practical use.

As for the polyimide and polyamide imide, common products readily available from manufacturers, such as Du Pont-Toray Co., Ltd., Ube Industries, Ltd., New Japan Chemical Co., Ltd., JSR Corporation, UNITIKA LTD., I.S.T., Hitachi Chemical Co., Ltd., TOYOBO CO., LTD., and Arakawa Chemical Industries, Ltd., can be used.

<Elastic Layer>

An elastic layer (12) to be laminated onto the base layer (11) will be explained next.

The elastic layer contains at least a material for forming an elastic layer, and an electric resistance adjusting agent, and may further other components, such as an antioxidant, a reinforcing agent, and a vulcanization accelerator, if necessary.

<<Material for Forming Elastic Layer>>

A material for forming the elastic layer is appropriately selected depending on the intended purpose without any limitation, and commonly used materials, such as a resin, elastomer, and rubber, can be used. However, it is preferred that a material having sufficient flexibility (elasticity) to sufficiently exhibit the effect of the present invention be used. An elastomer material or a rubber material is preferable.

Examples of the elastomer material include: thermoplastic elastomers, such as a polyester elastomer, a polyamide elastomer, a polyether elastomer, a polyurethane elastomer, a polyolefin elastomer, a polystyrene elastomer, a polyacryl elastomer, a polydiene elastomer, a silicone-modified polycarbonate elastomer, and a fluorocopolymer elastomer; and thermosetting elastomers, such as a polyurethane elastomer, a silicone-modified epoxy elastomer, and a silicone-modified acryl elastomer.

Examples of the rubber material include isoprene rubber, styrene rubber, butadiene rubber, nitrile rubber, ethylenepropylene rubber, butyl rubber, silicone rubber, chloroprene rubber, acrylic rubber, chlorosulfonated polyethylene, fluorine rubber, urethane rubber, and hydrin rubber.

As for the material for forming the elastic layer, a material that will give desirable properties can be appropriately selected from various elastomers and rubbers, but an acrylic rubber is particularly preferable for the present invention in view of ozone resistance, flexibility, adhesion to spherical particles, flame resistance, and stability to environment. The acrylic rubber will be explained hereinafter.

<<<Acrylic Rubber>>>

The acrylic rubber may be any of products currently commercially available, and is appropriately selected depending on the intended purpose without any limitation. Among various crosslinked (e.g. epoxy group, active chlorine group, and carboxyl group) acrylic rubbers, however, a carboxyl group-crosslinked acrylic rubber is preferable because the carboxyl group-crosslinked acrylic rubber is excellent in rubber properties (especially permanent compression set) and workability.

—Crosslinking Agent—

The crosslinking agent used for the carboxyl group-crosslinked acrylic rubber is appropriately selected depending on the intended purpose without any limitation, but it is preferably an amine compound, more preferably a polyvalent amine compound.

Examples of the amine compound include an aliphatic polyamine crosslinking agent, and an aromatic polyamine crosslinking agent.

Examples of the aliphatic polyamine crosslinking agent include hexamethylene diamine, hexamethylene diamine carbamate, and N,N'-dicinnamylidene-1,6-hexane diamine.

Examples of the aromatic polyamine crosslinking agent include 4,4'-methylene dianiline, m-phenylene diamine, 4,4'-diaminodiphenyl ether, 3,4'-diaminodiphenyl ether, 4,4'-(m-phenylene diisopropylidene)dianiline, 4,4'-(p-phenylene diisopropylidene)dianiline, 2,2'-bis[4-(4-aminophenoxy) phenyl]propane, 4,4'-diaminobenzanilide, 4,4'-bis(4-aminophenoxy)biphenyl, m-xylene diamine, p-xylene diamine, 1,3,5-benzene triamine, and 1,3,5-benzene triaminomethyl.

An amount of the crosslinking agent is appropriately selected depending on the intended purpose without any limitation, but the amount thereof is preferably 0.05 parts by mass to 20 parts by mass, more preferably 0.1 parts by mass to 5 parts by mass, relative to 100 parts by mass of acrylic rubber.

When the amount of the crosslinking agent is too little, a crosslink reaction is not performed sufficiently, and therefore it may be difficult to maintain a shape of the crosslinked product.

When the amount of the crosslinking agent is too much, the crosslinked product becomes excessively hard to thereby impair elasticity as a crosslinked rubber.

—Crosslink Accelerator—

The acrylic rubber elastic layer may further contain a crosslink accelerator in combination with a crosslinking agent. The crosslink accelerator is appropriately selected depending on the intended purpose without any limitation, but it is preferably a crosslink accelerator that can be used in combination with the polyamine crosslinking agent.

Examples of such crosslink accelerator include a guanidine compound, an imidazole compound, a quaternary onium salt, a polyvalent tertiary amine compound, a tertiary phosphine compound, and a weak acid alkali metal salt.

Examples of the guanidine compound include 1,3-diphenyl guanidine, and 1,3-diorthotolyl guanidine.

Examples of the imidazole compound include 2-methylimidazole, and 2-phenylimidazole.

Examples of the quaternary onium salt include tetra-n-butylammonium bromide, and octadecyl tri-n-butylammonium bromide.

Examples of the polyvalent tertiary amine compound include triethylene diamine, and 1,8-diazabicyclo[5.4.0]undec7-ene (DBU).

Examples of the tertiary phosphine compound include triphenyl phosphine, and tri-p-tolylphosphine.

Examples of the weak acid alkali metal salt include: inorganic weak acid salts such as phosphate and carbonate of sodium or potassium; and organic weak acid salts such as a stearic acid salt, and a lauric acid salt.

An amount of the crosslink accelerator is appropriately selected depending on the intended purpose without any limitation, but the amount thereof is preferably 0.1 parts by mass to 20 parts by mass, more preferably 0.3 parts by mass to 10 parts by mass, relative to 100 parts by mass of the acrylic rubber.

Use of the crosslink accelerator in an excessive amount may cause too fast crosslink speed during crosslinking, may cause blooming of the crosslink accelerator on a surface of the crosslinked product, or may result an excessively hard crosslink product. Use of the crosslink accelerator in an insufficient amount may significantly reduce tensile strength of a resulting crosslinked product, or may cause significant change in elongation or in tensile strength upon application of heat load.

A preparation method of the acrylic rubber is appropriately selected depending on the intended purpose without any limitation, but examples thereof include appropriate mixing methods, such as roll mixing, Banbury mixing, screw mixing, and solution mixing. The order for blending each ingredient is not particularly limited, but after sufficiently mixing components that are not easily reacted or decomposed with heat, for example, a crosslinking agent and the like can be mixed thereto as components that are easily reacted or decomposed with heat for a shot period at the temperature at which a reaction or decomposition will not occur.

The acrylic rubber can be formed into a crosslinked product by heating.

The heating temperature is appropriately selected depending on the intended purpose without any limitation, but the temperature is preferably 130° C. to 220° C., more preferably 140° C. to 200° C. The duration for crosslink is preferably 30 seconds to 5 hours.

The heating method is appropriately selected depending on the intended purpose without any limitation, and examples thereof include methods used for crosslink of rubbers, such as press heating, steam heating, oven heating, and hot air heating. After performing a process for crosslink, a post crosslink process may be performed to make the inner part of the crosslinked product surely crosslinked. The duration for the post crosslink may vary depending on the heating method, crosslink temperature, and the shape of the product, but it is preferably 1 hour to 48 hours. The heating method and temperature for the post crosslink may be appropriately selected.

The flexibility of the elastic layer is appropriately selected depending on the intended purpose without any limitation, but it is preferably 40 or less in micro rubber hardness determined at 25° C., 50% RH. The micro rubber hardness can be measured by means of a commercial micro rubber hardness meter, for example, a micro rubber hardness meter MD-1, manufactured by KOBUNSHI KEIKI CO., LTD.

A thickness of a center portion of the elastic layer is appropriately selected depending on the intended purpose without any limitation, but it is preferably 400 μm to 1,000 μm, more preferably 500 μm to 700 μm. When the thickness of the center portion of the elastic layer is less than 400 μm, desirable image quality to types of paper having surface irregularities may not be attained. When the thickness thereof is more than 1,000 μm, the weight of the elastic layer may become heavy, which tends to be bendy, or tends to cause large curling, causing unstable running. Moreover, at the curved part by the roller across which the belt is provided, cracks tend to be formed as bended at a curve of a roller, because the belt is provided across the rollers. Accordingly, the thickness thereof more than 1,000 μm is nor preferable.

Here, the thickness of the center portion of the belt means an average thickness of the belt in a region extending from a center of the belt to the both edges by 50 mm, in terms of the width direction of the elastic layer. As for the measurement method of the thickness of the center portion, the cross section of the belt cut along the width direction of the belt is observed under a scanning electron microscope (SEM), a thickness of the part of the belt where the spherical particles are not to embedded is measured in regions extending from the center to both edges by 50 mm in the width direction of the elastic layer, and the average value is calculated from the measured values. Moreover, the center in the width direction means a point which is present in the equidistance from both edges in the cross section cut along the width direction of the belt.

Figure 2:
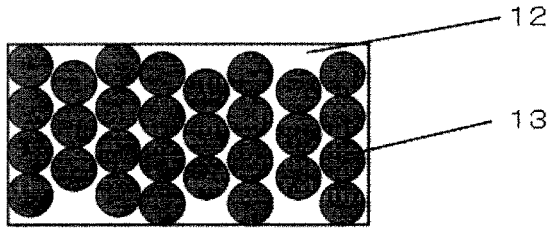
FIG. 2 is a schematic diagram illustrating one example of a surface configuration of the belt for an image forming apparatus of the present invention.

FIG. 2 depicts a schematic diagram of the belt of the present invention.

The thickness of the edge portion of the belt with respect to the thickness of the center portion of the belt in the width direction is appropriately selected depending on the intended purpose without any limitation, provided that it is 50% to 95%, but it is preferably 50% to 90%, more preferably 60% to 80%. Generally, the belt tends to curve to the outer side as the thickness of the elastic layer increases. However, as the belt of the present invention has the aforementioned structure, the belt is prevented from being curved for a long period, and has excellent durability, which is therefore preferable. The thickness of the center portion of the belt means an average thickness of the belt in a region extending from a center of the belt to the both edges by 50 mm, relative to the width direction of the elastic layer. The thickness of the edge portion of the belt means an average thickness of the belt in a region extending from either edge of the belt to the center by 50 mm, relative to the width direction of the belt. As for the measurement method of the thickness of the center portion, the cross section of the belt cut along the width direction of the belt is observed under a scanning electron microscope (SEM), a thickness of the part of the belt where the spherical particles are not embedded is measured in regions extending from the center to both edges by 50 mm in the width direction of the elastic layer, and the average value is calculated from the measured values. As for the measurement method of the thickness of the edge portion, the cross section of the belt cut along the width direction of the belt is observed under a scanning electron microscope (SEM), a thickness of the part of the belt where the spherical particles are not embedded is measured in regions extending from both edges to the center by 50 mm in the width direction of the elastic layer, and the average value is calculated from the measured values.

The thickness decreases from the center portion to the both edge portions. If the change in the thickness is significant, transfer pressure tends to be varied, which can form transfer unevenness on paper. Therefore, it is preferred, as with a barrel shape illustrated in FIG. 3, that the thickness inclination be given gradually. The belt of FIG. 3 includes a base layer 31 and an elastic layer including edge portion 32 center portion 33 and edge portion 34. Further, the thicknesses of both edge portions (right-left; front side, rear side) of the belt may be different, as long as it is 50% to 95% of the thickness of the center portion, but the thicknesses of the both edge portions are preferably the same in view of running stability.

The curing amount of the edge of the belt is appropriately selected depending on the intended purpose without any limitation, provide that it is 4 mm or less, but it is preferably 3 mm or less, more preferably 2.5 mm or less. When the curling amount of the edge portion is more than 4 mm, durability of the belt is not sufficient, and running failure may occur with such belt.

As for the measuring method of the curling amount of the edge portion, a sample cut out from the belt in the size of 100 mm in the circumferential direction (rotational direction)×the whole width is placed on a horizontal plane, a moisture of the sample is adjusted at 25° C., 50% RH for 24 hours, and then the average value of the heights of the both edge portions from the horizontal plane is calculated.

Moreover, a length of the belt in the width direction of the belt is preferably 300 mm or longer in view of high speed printing required in current electrophotography, high quality image, high durability.

Into the above-selected material, materials, such as a resistant adjusting agent for adjusting electric properties, optionally an antioxidant, a reinforcing agent, filler, and a vulcanization accelerator are appropriately blended.

<<Electric Resistance Adjusting Agent>>

A conductant agent is added as an electric resistance adjusting agent to adjust an electric resistance required for the intermediate transfer belt, because acrylic rubber per se has high electric resistance. Examples of the conductant agent include carbon, and an ion conductive agent. Among them, an ion conductive agent is preferable because rubber hardness is important property in the present invention, and the ion conductive agent is effective with a small amount thereof and does not adversely affect the rubber hardness. Examples of the ion conductive agent include various perchlorate salts, and ionic liquid. An amount of the ion conductive agent used is preferably 0.01 parts by mass to 3 parts by mass, relative to 100 parts by mass of the rubber. When the amount of the ion conductive agent is less than 0.01 parts by mass, the effect of reducing the electric resistance cannot be attained. When the amount of thereof is greater than 3 parts by mass, the conductant agent may be bloomed or bled on the surface of the belt. The electric resistance of the elastic layer is preferably adjusted to have $1\times10^{8}\Omega/\square$ to $1\times10^{13}\Omega/\square$ in surface resistance and $1\times10^{7}$ Ω·cm to $1\times10^{12}$ Ω·cm in volume resistance.

<Spherical Particles>

Next, the spherical particles (13) partially embedded in the elastic layer (12) will be explained.

The spherical particles are spherical particles each of which are partially embedded in the exposed surface of the elastic layer. Moreover, the spherical particles have the volume average particle diameter of 10 μm or smaller and have spherical shapes, and are particles insoluble to an organic solvent, and having 3% thermal decomposition temperature of 200° C. or higher.

The sphericity of the spherical particles is preferably 0.90 to 1.00, more preferably 0.93 to 1.00.

The shape of each spherical particle is spherical, which can be represented by the following shape definition.

Figure 7A:
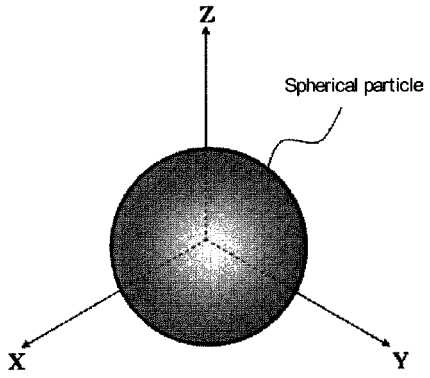
FIGS. 7A to 7C are each a schematic diagram illustrating a shape of a spherical particle for use in the present invention.
Figure 7B:
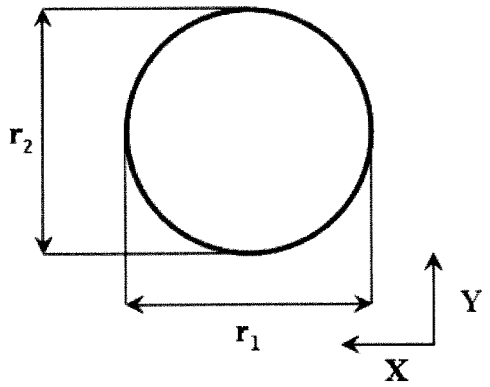
Figure 7C:
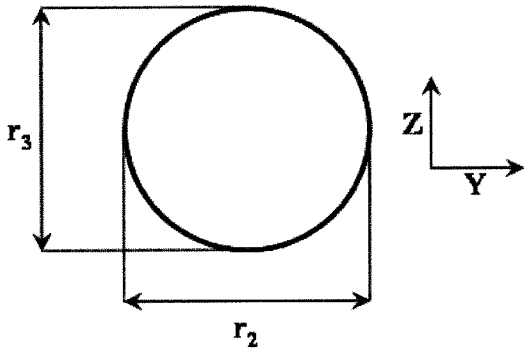

FIGS. 7A to 7C are each a schematic diagram illustrating a shape of the spherical particle. In FIG. 7A, a long axis, a short axos, and a thickness of a circular particle are respectively defined as $r_1$, $r_2$, and $r_3$ (provided, $r_1 \geq r_2 \geq r_3$). The particle, which satisfies that a ratio of the long axis and the short axis ($r_2/r_1$, see FIG. 7B) is 0.9 to 1.0 and a ratio of the thickness and the short axis ($r_3/r_2$, see FIG. 7C) is 0.9 to 1.0, is determined as a spherical particle.

When the ratio of the long axis and the short axis ($r_2/r_1$) and the ratio of the thickness and the short axis ($r_3/r_2$) are both less than 0.9, the shape of particle is departed from a spherical shape, and therefore a space between the particles becomes large, which may cause a problem that a toner may not be transferred very well, or cleaning failures occur. Accordingly, high quality images cannot be obtained.

Note that, the long axis $r_1$, short axis $r_2$ and thickness $r_3$ can be measured, for example, by the following method. Specifically, the spherical particles are uniformly dispersed and deposited on a smooth measuring surface, and by means of a color laser microscope (e.g., VK-8500, manufactured by Keyence Japan), 100 spherical particles are enlarged with the magnification of 1,000 times, and the long axes $r_1$ (μm), the short axes $r_2$ (μm), and thicknesses $r_3$ (μm) of the 100 spherical particles are measured, and the arithmetic mean values of these values as measured are calculated and determined as the long axis $r_1$, short axis $r_2$ and thickness $r_3$.

Moreover, examples of the organic solvent include alcohols, esters, ketones, ethers, cellosolves, alicyclic hydrocarbon, aliphatic hydrocarbon, and aromatic hydrocarbon. The phrase "insoluble to an organic solvent" means that solubility thereof to the organic solvent is less than 1% by mass at ambient temperature and pressure.

The "3% thermal decomposition temperature" means heating temperature at which 3% by mass of mass reduction is caused, which can be measured by thermogravimetry-differential thermal analyzer (TG/DTA) (e.g., EXSTAR TGDTA7000, manufactured by SII Nano Technology Inc.).

The spherical particles are appropriately selected depending on the intended purpose without any limitation, and examples thereof include spherical particles containing, as a main component, a resin (e.g., an acrylic resin, a melamine resin, a polyamide resin, a polyester resin, a silicone resin, and a fluororesin). Moreover, particles each containing any of the aforementioned resin as a main component, and subjected to surface treatment with another material may also be used as the spherical particles.

Moreover, the spherical particles mentioned in the present specification also include particles of a rubber material. Also, spherical particles produced from a rubber material, each surface of which is coated with a hard resin, can be also applied as the spherical particles.

Further, the spherical particles may be hollow or porous.

Among these spherical particles, silicone spherical particles are particularly preferable because they have high functions, i.e., giving releasing ability to a toner, and abrasion resistance. The spherical particles are particles produced by any of these resins by a polymerization method to give the shape as circular as possible, and in the spherical particles for use in the present invention are preferably very close to sphere.

Moreover, the volume average particle diameter of the spherical particles are appropriately selected depending on the intended purpose without any limitation, provided that it is 10 μm or smaller. It is preferred that the spherical particle have the volume average particle diameter of 0.5 μm to 5.0 μm, and be monodisperse particles. The term "monodisperse particles" used in the present specification do not mean particle having the same particle diameter, but means particles having an extremely sharp particle size distribution. Specifically, preferred are particles having a distribution width of ±(volume average particle diameter×0.5) μm or less. When the volume average particle diameter is smaller than 0.5 μm, an effect of the particles for giving transfer ability cannot be sufficiently attained. When the volume average particle diameter is greater than 10 μm, a surface roughness of the belt becomes large, and a space between particles becomes large. As a result, the toner may not be able to be transferred very well, or cleaning failure may occur.

Further, as many of the spherical particles have high insulation properties, the spherical particles of excessively large particle diameter may cause residual charge potential, and the accumulated potential may cause disturbance in images when images are continuously output. Note that, the timing for applying the spherical particles onto a surface of the elastic layer is not particularly limited, and it may be either before or after vulcanization of rubber.

The spherical particles are not particularly limited, and may be appropriately synthesized for use, or selected from the commercially available products. Examples of the commercially available product include silicone particles (product of Momentive Performance Materials Inc., trade names "TOSPEARL 120," "TOSPEARL 145" "TOSPEARL 2000B") and acryl particles (product of SEKISUI PLASTICS CO., LTD., trade name "Techno Polymer MBX-SS").

<Surface Profile of Belt>

The preferable surface profile of the belt of the present invention will be explained next.

Figure 3:
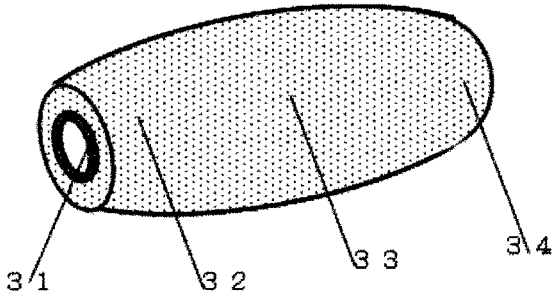
FIG. 3 is a schematic diagram exaggeratedly illustrating one example of the belt for an image forming apparatus of the present invention to make the outline of the appearance thereof significant.

FIG. 3 depicts an enlarged schematic diagram observing the surface of the belt from the top. As illustrated in FIG. 3, the embodiment of the belt includes the spherical particles having uniform particle diameters, which are each regularly aligned. There is rarely observed the spherical particles superimposed onto each other. The particles diameters of the spherical particles constituting the surface, provided on the exposed surface of the elastic layer, are preferably as uniform as possible, specifically preferably having the distribution width of ±(average particle diameter×0.5) μm.

Use of the spherical particles having particle diameters as uniform as possible is preferable to form the aforementioned alignment, but it is also acceptable that particles of certain particle diameters are selectively exposed to the surface to form the surface that achieve the aforementioned particle size distribution, without using the spherical particles of uniform particle diameters.

The rate of the spherical particles occupying the exposed surface of the elastic layer is preferably 60% or higher. When the rate thereof is lower than 60%, the exposed area of the material constituting the elastic layer is too large so that the toner may be in contact with the material constituting the elastic layer. As a result, it is often the case that desirable transfer property may not be attained.

The present invention has a configuration that the spherical particles are partially embedded in the exposed surface of the elastic layer. The embedding rate (%) thereof is preferably more than 50% but less than 100%, more preferably in the range of 51% to 90%. When the embedding rate thereof is 50% or less, the spherical particles may fall off from the belt during use in the image forming apparatus over a long period, and therefore the resulting belt has insufficient durability. When the embedding rate thereof is 100%, the effect of the spherical particles to contributing the transfer property of the belt is reduced and therefore it is not preferable.

The term "embedding rate" is a rate of a particle diameter of a spherical particle embedding in the elastic layer in the depth direction. The embedding rate used in the present specification does not mean that all of the spherical particles satisfying the embedding rate of more than 50% but less than 100%, but means that when it is seen from one visual field, the average embedding rate of the spherical particles within the visual field is more than 50% but less than 100%. Note that, when the embedding rate is 50%, particles completely embedded inside the elastic layer are rarely observed by a cross-sectional observation under an electron microscope.

One example of a method for producing the belt having the configuration of the present invention will be explained next. First, a production method of the base layer (11) will be explained.

A method for producing the base layer using, as a coating liquid containing at least a resin component, a coating liquid containing polyimide resin precursor or polyamide imide resin precursor will be explained.

Figure 4:
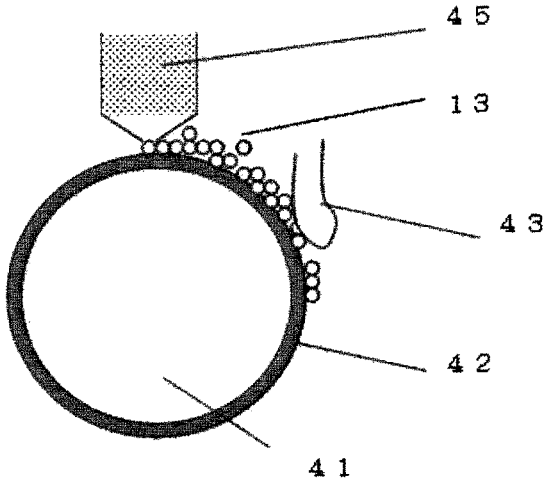
FIG. 4 is a schematic diagram explaining one example of the method for forming an elastic layer of the belt for an image forming apparatus of the present invention, which has irregular surface configuration formed with spherical particles.

A coating liquid containing at least a resin component (e.g., a coating liquid containing polyimide resin precursor or polyamide imide resin precursor) is applied onto a cylindrical mold, such as a cylindrical metal mold (e.g., a meta mold (41)

illustrated in FIG. 4), by a liquid supplying device, such as a nozzle and a dispenser, while slowly rotating the cylindrical mold, so as to uniformly coat and flow cast the outer surface of the cylindrical mold with the coating liquid, to thereby form a coating film. Thereafter, the rotational speed is increased to a predetermined speed. Once the rotational speed reaches the predetermined speed, the rotational speed is maintained constant, and the rotation is continued for a predetermined period. Then, the temperature is gradually elevated while rotating the cylindrical mold, to thereby evaporate the solvent in the coating film at the temperature of about 80° C. to about 150° C. It is preferred that the vapor (e.g., the evaporated solvent) in the atmosphere be efficiently circulated and removed. Once a self-supporting film is formed, the mold with the film is placed in a heating furnace (baking furnace) capable of performing a high temperature treatment. Then, the temperature of the furnace is increased stepwise, and eventually a high temperature heat treatment (baking) is performed at the temperature ranging from about 250° C. to about 450° C., to thereby sufficiently imidize the polyimide precursor or polyamide imidize the polyamide imide resin precursor. After sufficiently cooling the resulting film, an elastic layer (12) will be sequentially laminated.

The elastic layer (12) can be formed by applying a rubber coating liquid, which is prepared by dissolving rubber in an organic solvent, onto the base layer, followed by drying the solvent, and performing vulcanization. As for the coating method, likewise the formation of the base layer, conventional coating methods, such as spiral coating, die coating, and roll coating, can be used. Since a thickness of the elastic layer is preferably thick to improve convex-concave transfer property, die coating and spiral coating are excellent as a coating method for forming a thick film. The spiral coating is excellent as it can easily change the thickness of the elastic layer along the width direction as mentioned earlier. Accordingly, the method using spiral coating will be explained here.

First, a rubber coating liquid is spirally applied onto the base layer, while rotating the base layer in the circumferential direction, by continuously supplying the rubber coating liquid from a round or broad-line nozzle and moving the nozzle along the axial direction of the base layer. The coating liquid spirally applied onto the base layer is leveled and dried by maintaining the predetermined rotational speed and drying temperature. Thereafter, the resultant is subjected to vulcanization (crosslinking) at the predetermined vulcanizing temperature, to thereby form an elastic layer. To change a thickness along the width direction, an ejection amount of the nozzle may be changed, or a distance between the nozzle and the metal mold may be changed, or the rotational speed of the metal mold may be changed.

FIG. 3 depicts a schematic diagram of a belt produced in the aforementioned manner.

<Method for Producing Belt Surface Configuration>

The vulcanized elastic layer is sufficiently cooled, followed by applying the spherical particles (13) on the elastic layer (12) and embedding the spherical particles (13) therein to thereby produce a predetermined seamless belt (intermediate transfer belt) in which the spherical particles are partially embedded in the exposed surface of the elastic layer. The method for partially embedding the spherical particles in the exposed surface of the elastic layer includes, as illustrated in FIG. 4, providing a powder supplying device (45) and a pressing member (43), evenly applying spherical particles from the powder supplying device (45) to a surface of the elastic layer of the laminate (42) containing the base layer and the elastic layer, while rotating the laminate (42), and pressing the spherical particles evenly spread on the surface with the pressing member (43) at constant pressure. The pressing member (43) removes excess spherical particles as well as embedding the spherical particles in the elastic layer. Especially in the case where monodisperse spherical particles are used, in accordance with the present invention, the spherical particles can be evenly and partially embedded in the exposed surface of the elastic layer with a simple process consisting of leveling with the aforementioned pressing member.

A method for adjusting the embedding rate of the spherical particles in the exposed surface of the elastic layer is appropriately selected depending on the intended purpose without any limitation, and examples thereof include: a method for adjusting the embedding rate by adjusting the duration for pressing with the pressing member (43); and a method for adjusting the embedding rate by adjusting pressing force of the pressing member (43). In the case where the embedding rate is adjusted by adjusting the pressing force of the pressing member, the embedding rate of more than 50% but less than 100% can be relatively 1 to easily achieved by adjusting the pressing force to the range of 1 mN/cm to 1,000 mN/cm, for example with the flow cast coating liquid having the viscosity of 100 mPa·s to 100,000 mPa·s, although it depends on viscosity and solid content of the flow casting coating liquid, an amount of the solvent therein, and a material of the particles.

After evenly aligning the spherical particles on the surface, the laminate of the elastic layer and the base layer is heated at the predetermined temperature for the predetermined period while rotating, to thereby form the cured elastic layer in which the spherical particles have been embedded. After sufficiently cooling, the elastic layer together with the base layer is removed from the metal mold, to thereby obtain the predetermined seamless belt (intermediate transfer belt).

<Measurement Method of Embedding Rate>

The method for measuring the embedding rate of the spherical particles is appropriately selected depending on the intended purpose without any limitation, and for example, it can be measured by observing a cross section of the belt under a scanning electronic microscope (SEM).

Specifically, the embedding rate (%) can be measured by observing the cross section of the belt cut out along the width direction of the belt under a scanning electronic microscope, measuring a rate (%) of diameters of the spherical particles, centers of which are on the cross section, embedding in the elastic layer in the depth direction, and calculating an average value from the measured values. In the case where the resin particles are monodisperse particles, the embedding rate can be measured by calculating a rate (%) of diameters of the resin particles embedding the elastic layer in the depth direction from the diameter (2r) of a circle of the resin particle (exposed surface) exposed on the belt surface as seen from a top of the belt, and the volume average particle diameter (2R) of the resin particles according to the following formula (1), and calculating an average value from the calculated values.

$$\text{Embedding rate}(\%)=R+(R^2-r^2)^{1/2}\times 100/2R \qquad \text{Formula (1)}$$

The resistance of the thus produced belt is adjusted by varying an amount of the carbon black, or ion conductive agent. Attention should be paid during the adjustment of the resistance, as the resistant tends to be varied depending on the size of the particles or the occupying area rate. As for the measurement of the resistance, a commercially available measuring device can be used, and for example, the resistance can be measured by means of Hiresta, manufactured by Mitsubishi Chemical Analytech Co., Ltd.

In case of an intermediate transfer belt, the resistance of the belt is preferably $1\times10^8\Omega/\square$ to $1\times10^{10}\Omega/\square$ in surface resistance, and $1\times10^7$ Ω·cm to $1\times10^{12}$ Ω·cm in volume resistance.

<Image Forming Apparatus>

The image forming apparatus of the present invention contains an image bearing member configured to form a latent image thereon and bear a toner image thereon; a developing unit configured to develop the latent image formed on the image bearing member with a toner; an intermediate transfer belt configured to primary transfer thereon the toner image developed by the developing unit; and a transfer unit configured to secondary transfer the toner image on the intermediate transfer belt onto a recording medium. The image forming apparatus of the present invention may contain appropriately selected other units, such as a diselectrification unit, a cleaning unit, a recycling unit, and a controlling unit, if necessary.

The intermediate transfer belt is the aforementioned belt for an image forming apparatus of the present invention. Moreover, the intermediate transfer belt is preferably a seamless belt.

In this case, it is preferred that the image forming apparatus be a full-color image forming apparatus, in which a plurality of latent image bearing members are tandemly provided and around each image bearing member, a developing unit of a corresponding color is provided.

The seamless belt suitably used in a belt structure unit mounted in an electrophotographic device (referred to as "image forming apparatus" hereinafter) of the present invention will be specifically explained hereinafter with reference to the main section schematic diagram. Note that, the schematic diagram illustrates one example, and shall not be construed as to limit the scope of the present invention.

Figure 5:
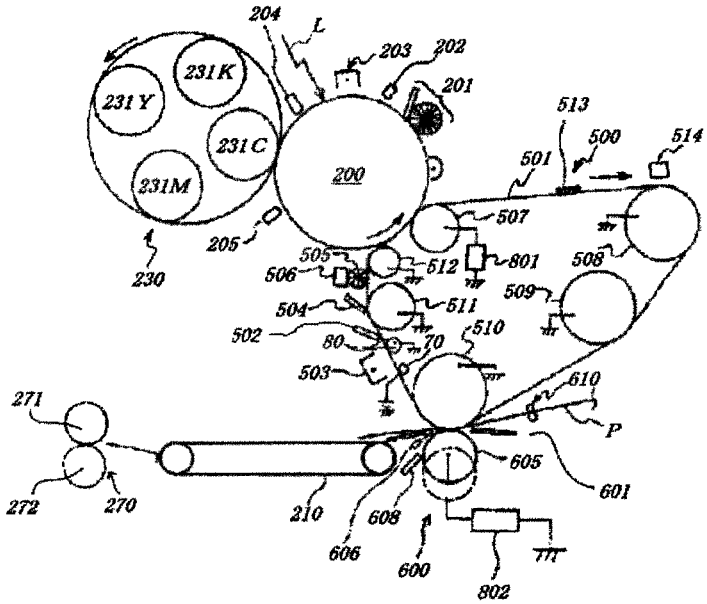
FIG. 5 is a schematic diagram of a main section, which illustrates one example of an image forming apparatus equipped with a seamless belt according to the present invention.

FIG. 5 is a schematic diagram of a main section for explaining one example of the image forming apparatus of the present invention equipped with the seamless belt of the present invention as a belt member.

The intermediate transfer unit (500) including the belt member of FIG. 5 include an intermediate transfer belt (501) provided across a plurality of rollers. In the surrounding area of the intermediate transfer belt (501), a secondary transfer bias roller (605), which is a secondary transfer charge applying unit of a secondary transfer unit (600), a belt cleaning blade (504), which is an intermediate transfer belt cleaning unit, and a lubricant applying brush (505), which is a lubricant applying member of a lubricant applying unit are provided so as to face the intermediate transfer belt (501).

Moreover, a position detecting mark (not illustrated) is provided on the outer surface or inner surface of the intermediate transfer belt (501). In the case where the position detecting mark is provided on the outer surface of the intermediate transfer belt (501), the position detecting mark needs to be provided to avoid the region where a belt cleaning blade (504) will pass through, which is sometimes difficult in view of the arrangements. In such case, the position detecting mark may be provided on the side of the inner surface of the intermediate transfer belt (501). An optical sensor (514) as a mark detecting sensor is provided in the position between a primary transfer bias roller (507), and a belt driving roller (508) around which the intermediate transfer belt (501) is provided.

The intermediate transfer belt (501) is provided across the primary transfer bias roller (507), which is a primary transfer charge applying unit, the belt driving roller (508), a belt tension roller (509), a secondary transfer counter roller (510), a cleaning counter roller (511), and a feed back current detecting roller (512). Each roller is formed of an electric conductive material, and all of the rollers, exclusive of the primary transfer bias roller (507), are earthed. To the primary transfer bias roller (507), transfer bias whose current or voltage is controlled to have a certain value depending on the number of toner images superimposed is applied from a primary transfer power source (801) which is controlled to provide constant current or constant voltage.

The intermediate transfer belt (501) is driven to rotate in the direction shown with the arrow by a belt driving roller (508) that is driven to rotate in the direction shown with the arrow by a driving motor (not illustrated).

The belt member, the intermediate transfer belt (501), is typically a semiconductor or insulator, and has a single layer or multilayer structure. In the preferable embodiment of the present invention, a seamless belt is preferably used, and using the seamless belt as the intermediate transfer belt enables to improve the durability of the intermediate transfer belt, as well as realizing excellent image formation. Moreover, the intermediate transfer belt is designed to have a size larger than the maximum size for feedable paper so that toner images formed on a photoconductor drum (200) can be superimposed thereon.

The secondary transfer bias roller (605), which is a secondary transfer unit, is mounted detachable to the area in the outer surface of the intermediate transfer belt (501) where it is supported around the secondary transfer counter roller (510), by a separation system serving as the below-mentioned moving unit. The secondary transfer bias roller (605) is mounted so as to nip a recording paper with the area of the intermediate transfer belt (501) where it is supported around the secondary transfer counter roller (510). To the secondary transfer bias roller (605), transfer bias of the predetermined current is applied from the secondary transfer power source (802) which is controlled to provide constant current.

The registration rollers (610) are configured to send the transfer paper (P), which is a transfer member, between the secondary transfer bias roller (605) and the intermediate transfer belt (501) supported by the secondary transfer counter roller (510), with the predetermined timing. Moreover, a cleaning blade (608), which is a cleaning unit, is brought into contact with the secondary transfer bias roller (605). The cleaning blade (608) is configured to remove the depositions deposited on the surface of the secondary transfer bias roller (605) to thereby clean the secondary transfer bias roller (605).

Once a image formation cycle is started in the color photocopier of the aforementioned structure, the photoconductor drum (200) is rotated in the anticlockwise direction shown with the arrow by the driving motor (not illustrated), and operations are performed to form a black (Bk) toner image, a cyan (C) toner image, a magenta (M) toner image, and a yellow (Y) toner image on the photoconductor drum (200). The intermediate transfer belt (501) is rotated in the clockwise direction shown with the arrow by the belt driving roller (508).

Along the rotation of the intermediate transfer belt (501), primary transfer of the Bk toner image, the C toner image, the M toner image, and the Y toner image are performed by transfer bias generated by the voltage applied to the primary transfer bias roller (507), and ultimately each of the toner images are superimposed and formed in the order of Bk, C, M, and Y on the intermediate transfer belt (501).

For example, the formation of the Bk toner image is carried out in the following manner.

In FIG. 5, a charger (203) uniformly charges the surface of the photoconductor drum (200) with the negative charge of the predetermined electric potential by corona discharge. Based on the belt mark detecting signal, the timing for the operation is determined, and ruster exposure is carried out with laser light (L) by means of a writing optical unit (not illustrated) based on the Bk color image signal. When the ruster image is formed by the exposure, the exposed area of the initially uniformly charged surface of the photoconductor drum (200) loses its electric charge in the amount proportional to the exposure value, to thereby form a Bk latent electrostatic image. By bringing the negatively charged Bk toner on a developing roller of the Bk developing unit (231Bk) into contact with the Bk latent electrostatic image, the toner is adsorbed on the area of the photoconductor drum (200) where there is not electric charge, that is the exposed area, without depositing the toner on the area where the electric charge remains, to thereby form a Bk toner image identical to the latent electrostatic image.

The Bk toner image formed on the photoconductor drum (200) in the aforementioned manner is primary transferred to the outer surface of the intermediate transfer belt (501) which is driven to rotate at the same speed to the rotational speed of the photoconductor drum (200) in the state that it is in contact with the photoconductor drum (200). After the primary transferring, a small amount of the toner remained on the surface of the photoconductor drum (200) without being transferred is cleaned by a photoconductor cleaning device (201) to thereby be recovered and re-used for the photoconductor drum (200). After the formation of the Bk image, the photoconductor drum (200) proceeds to the operation for a C image formation. The color scanner starts reading the C image data with the predetermined timing, and a C latent electrostatic image is formed on the surface of the photoconductor drum (200) by writing the C image data with laser light.

After the rear edge of the Bk latent electrostatic image is passed through and before the top edge of the C latent electrostatic image reaches, a revolver developing unit (230) is revolved to set the C developing unit (231C) in the developing position, and the C latent electrostatic image is developed with the C toner. Thereafter, the region of the C latent electrostatic image is continued to be developed. When the rear edge of the C latent electrostatic image is passed through, however, the revolver developing unit is revolved in the same manner in the case of the aforementioned K developing unit (231K), to move the M developing unit (231M) into the developing position. This operation is completed, as in the manner mentioned above, before the top edge of the next Y latent electrostatic image reaches. The explanations of operations for M image formation and Y image formation are omitted here because the operations of color image reading, latent electrostatic formation, and developing are the same to those of Bk, and C.

The Bk, C, M, and Y toner images sequentially formed on the photoconductor drum (200) in the aforementioned manner are sequentially positioned and primary transferred on the identical surface of the intermediate transfer belt (501). As a result, a toner image, in which at maximum, four colors are superimposed, is formed on the intermediate transfer belt (501). Meanwhile, with the timing of starting the operation of the image formation, the transfer paper P is fed from the paper feeding unit, such as a transfer paper cassette and a manual feeding tray, and is stood by at the nip between the registration rollers (610).

When the top edge of the toner image on the intermediate transfer belt (501) comes to a secondary transfer section formed with a nip between the intermediate transfer belt (501) supported by the secondary transfer counter roller (510) and the secondary transfer bias roller (605), the registration rollers (610) are driven to transfer the transfer paper along the transfer paper guide plate (601) in the manner that the top edge of the transfer paper (P) meets the top edge of the toner image, to thereby perform the registration of the transfer paper (P) with the toner image.

Once the transfer paper (P) reaches the secondary transfer section in the manner described above, the four-color superimposed toner images on the intermediate transfer belt (501) are collectively transferred (secondary transferred) onto the transfer paper (P) by transfer bias generated by the voltage applied to the secondary transfer bias roller (605) by the secondary transfer power source (802). The transfer paper is then transported along the transfer paper guide plate (601), and is diselectrified by passing the area facing to the transfer paper diselectrification charger (606) formed of a diselectrification needle, disposed in the downstream of the secondary transfer section, followed by transported towards a fixing device (270) by a belt conveying device (210), which is a belt element structure unit. Thereafter, the toner image on the transfer paper (P) is fused and fixed thereon at the nip between the fixing rollers (271), (272) of the fixing device (270), followed by sending out the transfer paper (P) from the device main body by discharging roller (not illustrated) to be stacked on a copy tray (not illustrated) with the top side up. Note that, the fixing device (270) optionally has a belt structure unit, if necessary.

Meanwhile, the surface of the photoconductor drum (200) after the belt transferring is cleaned by the photoconductor cleaning device (201), and is uniformly diselectrified by the diselectrification lamp (202). Moreover, the residual toner on the outer surface of the intermediate transfer belt (501) after secondary transferring the toner images on the transfer paper (P) is cleaned by a belt cleaning blade (504). The belt cleaning blade (504) is designed to come into contact with the outer surface of the intermediate transfer belt (501) with the predetermined timing by means of a cleaning member moving unit, which is not illustrated in the drawing.

At the upstream of the belt cleaning blade (504) in the traveling direction of the intermediate transfer belt (501), a toner sealing member (502) coming in contact with and moving away from the outer surface of the intermediate transfer belt (501) is provided. The toner sealing member (502) receives the toner fell off from the belt cleaning blade (504) during the cleaning of the residual toner, to thereby prevent the fallen toner from scattering onto the transporting path of the transfer paper (P). The toner sealing member (502) is brought into contact with or moved away from the outer surface of the intermediate transfer belt (501) by means of the cleaning member moving unit, together with the belt cleaning blade (504).

To the outer surface of the intermediate transfer belt (501) from which the residual toner has been removed in the aforementioned manner, a lubricant (506) is applied by a lubricant applying brush (505). The lubricant (506) is formed of a solid, such as zinc stearate, and is provided so as to be in contact with the lubricant applying brush (505), Moreover, the residual charge remained on the outer surface of the intermediate transfer belt (501) is eliminated by diselectrification bias applied by a belt diselectrification brush, which is not illustrated, and is provided to be in contact with the outer surface of the intermediate transfer belt (501).

Here, the lubricant applying brush (505) and the belt diselectrification brush are each designed to come into contact with and move away from the circumferential surface of the intermediate transfer belt (501) with the predetermined timing, by means of a moving unit not illustrated in the drawing.

In the case of repeated photocopying, as for the operations of the color scanner and the image formation on the photoconductor drum (200), the image forming operation of the first color (Bk) for the second sheet starts with the predetermined timing following to the image forming operation of the fourth color (Y) for the first sheet. Moreover, following to the operation for collectively transferring the superimposed four color toner images for the first sheet, the intermediate transfer belt (501) receives the Bk toner image for the second sheet, which is primary transferred, with the region of the circumferential surface thereof where cleaning has been performed with the belt cleaning blade (504). The same operation to that for the first sheet is performed thereafter. The explained above is a copy mode to give a four color full-color copy, but in case of a three color copy mode or two color copy mode, the same operations to the above are performed according to the designated colors and rotations. In the case of a monocolor copy mode, only the developing device of the predetermined color of the revolver developing unit (230) is driven in the developing operation state before copying of the predetermined number of sheets is completed, and the copying operation is performed with the belt cleaning blade (504) remaining in contact with the intermediate transfer belt (501).

In FIG. 5, the numeral reference 70 denotes a diselectrification 15*s* roller, the numeral reference 80 denotes an earth roller, the numeral reference 204 denotes an electric potential sensor, the numeral reference 205 denotes a toner image density sensor, the numeral reference 503 denotes a charger, and the numeral reference 513 denotes a toner image.

Figure 6:
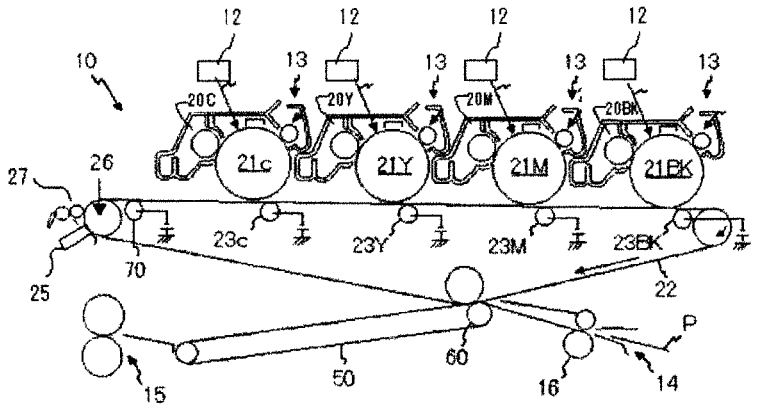
FIG. 6 is a schematic diagram of a main section, which illustrates another example of an image forming apparatus equipped with a seamless belt according to the present invention.

Although the photocopier equipped with only one photoconductor drum has been explained in the embodiment above, the present invention can be also applied for an image forming apparatus in which a plurality of photoconductor drums are aligned and provided along one intermediate transfer belt formed of a seamless belt, for example, as illustrated in FIG. 6 of the main section schematic diagram.

FIG. 6 illustrates one configuration example of a four-drum digital color copier equipped with four photoconductor drums (21BK), (21Y), (21M), (21C) for forming toner images of four different colors (black, yellow, magenta, and cyan).

In FIG. 6, the printer main body (10) is equipped with an image writing unit (12), an image forming unit (13), and a paper feeding unit (14), all of which are for performing color image formation by electrophotography. Image processing is performed by an image processing unit based on the image signal to convert into signals for each color black (BK), magenta (M), yellow (Y), cyan (C) for image forming, and the resulting signals are sent to the image writing unit (12). The image writing unit (12) is a scanning optical system, for example, constituted of a laser light source, a deflector such as a rotating polygon mirror, a scanning imagery optical system, and a group of mirrors, and has four wiring optical paths each corresponding to a respective color signal. The image writing unit (12) writes on each of the image bearing members (photoconductors) (21BK), (21M), (21Y), (21C), which are image bearing members each provided for a respective color in the image forming unit (13), corresponding to each color signal.

The image forming unit (13) is equipped with the photoconductors (21BK), (21M), (21Y), (21C), which are image bearing members for black (BK), magenta (M), yellow (Y), and cyan (C), respectively.

As for each photoconductor of each color, an OPC photoconductor is generally used. In the surrounding area of each of the photoconductors (21BK), (21M), (21Y), (21C), a charging device, a section exposed to laser light emitted from the image wiring unit (12), a developing device (20BK), (20M), (20Y), or (20C) of a respective color, black, magenta, yellow or cyan, a primary transfer bias roller (23BK), (23M), (23Y) or (23C) as a primary transferring unit, a cleaning device to (not illustrated), and a photoconductor diselectrification device (not illustrated) are provided. Note that, the developing devices (20BK), (20M), (20Y), (20C) apply a two-component magnetic brush developing system. The intermediate transfer belt (22), which is a belt element, is present between each of the photoconductors (21BK), (21M), (21Y), (21C) and each of the primary transfer bias rollers (23BK), (23M), (23Y), (23C), and the toner image of each color formed on a respective photoconductor is successively superimposed and transferred.

Meanwhile, the transfer paper (P) is borne with the transfer conveying belt (50), which is a belt component, via the registration rollers (16), after fed from a paper feeding unit (14). At the position where the intermediate transfer belt (22) is in contact with the transfer conveying belt (50), the toner images transferred onto the intermediate transfer belt (22) are secondary transferred (correctively transferred) to the transfer paper (P) by a secondary transfer bias roller (60) serving as the secondary transferring unit. In the manner as mentioned above, a color image is formed on the transfer paper (P).

The transfer paper (P) on which the color image has been formed is transported to the fixing device (15) by the transfer conveying belt (50), and the transferred image is fixed by the fixing device (15), followed by discharging the transfer paper (P) from the printer main body.

Note that, the residual toner remained on the intermediate transfer belt (22) without being transferred at the time of the secondary transfer is removed from the intermediate transfer belt (22) by the belt cleaning member (25).

At the downstream side of the belt cleaning member (25), a lubricant applying device (27) is provided. The lubricant coating device (27) contains a solid lubricant, and an electric conductive brush configured to apply the solid lubricant by rubbing the solid lubricant with the intermediate transfer belt (22). The electric conductive brush is always in contact with the intermediate transfer belt (22) to apply the solid lubricant to the intermediate transfer belt (22). The solid lubricant has functions of enhancing cleaning ability of the intermediate transfer belt (22), and preventing occurrences of filming to improve the durability.

In FIG. 6, the numeral reference 26 denotes a driving roller, and the numeral reference 70 denotes a diselectrification roller.

EXAMPLES

The present invention will be more specifically explained based upon Examples hereinafter, but the present invention shall not be construed as limited to these Examples. Modifications appropriately applied to these Examples shall be also within the scope of the present invention, as long as they are within the spirits of the present invention. Note that, a thickness of a belt was determined by observing a cross-section of the belt under a scanning electron microscope (SEM). The center portion thickness (C) with respect to the width direction of the belt was measured by determining the average thickness of the portion where the spherical particles are not embedded in the region extending from the center to the directions of the both edges by 50 mm each. The edge portion thicknesses (front side, and rear side, which are referred to as "F" and "R" respectively) were each measured by determining the average thickness of the portion where the spherical particles are not embedded in the region extending from the respective edge by 50 mm in the width direction. Moreover, a curling amount of the edge portion of the belt was determined by preparing a sample cut out in the size of 100 mm in the circumferential direction (rotational direction) of the belt×the entire width, placing the sample on a horizontal plane, adjusting a moisture of the sample at 25° C., 50% RH for 24 hours, and calculating the average value of heights of the both edge portion from the horizontal plane.

Example 1

A coating liquid for a base layer was prepared in the following manner, and using the coating liquid, a seamless belt base layer is produced.

(Preparation of Base Layer Coating Liquid)

First, a dispersion liquid preferred in advance by dispersing in N-methyl-2-pyrrolidone, carbon black (Special Black 4, manufactured by Evonik Degussa Japan Co., Ltd.) by means of a bead mill was blended to polyimide varnish (U-varnish A, manufactured by Ube Industries, Ltd.) containing polyimide resin precursor (polyamic acid) as a main component so that the carbon black content became 17% by mass of the polyamic acid solid content. The resultant was sufficiently stirred and mixture to thereby prepare a coating liquid.

(Production of Polyimide Base Layer Belt)

Next, a metal cylindrical support having an outer diameter of 500 mm and a length of 400 mm, surface of which had been roughened by a blast treatment, was used as a mold, and was mounted in a roll coating device.

Subsequently, Base Layer Coating Liquid A was poured into a pan, the coating liquid was scoped with a coating roller having a rotational speed of 40 mm/sec. A thickness of the coating liquid on the coating roller was controlled by setting a gap between a regulating roller and the coating roller to 0.6 mm.

Thereafter, the rotational speed of the cylindrical support was controlled at 35 mm/sec, and was brought close to the coating roller. Setting the gap between the cylindrical support and the coating roller to 0.4 mm, the coating liquid on the coating roller was uniformly transferred and coated on the cylindrical support. While maintaining the rotation of the cylindrical support, the cylindrical support on which the coating liquid had been applied was introduced into a hot air circulating dryer to gradually increase the temperature to 110° C., and heated the applied coating liquid for 30 minutes. The temperature was further increased to 200° C. and heated at the same temperature for 30 minutes, followed by stopping the rotation. Thereafter, the resultant was introduced into a heating furnace capable of performing a high temperature treatment (baking furnace), and the temperature was increased stepwise up to 320° C. to perform heating (baking) for 60 minutes. The resultant was then sufficiently cooled, to produce Polyimide Base Layer Belt A having a thickness of 60 μm.

(Production of Elastic Layer onto Polyimide Base Layer Belt)

Ingredients depicted in Table 1 were blended with a blending ratio depicted in Table 1, and the resultant was kneaded to thereby produce a rubber composition.

TABLE 1

| | |
|---|---|
| Acrylic rubber (Nipol AR12, ZEON CORPORATION) | 100 parts by mass |
| Stearic acid (beads stearic acid Tsubaki, NOF Corporation) | 1 part by mass |
| Red phosphorous (Nova Excel 140F, Rinkagaku Kogyo Co., Ltd.) | 10 parts by mass |
| Aluminum hydroxide (HIGILITE H42M, manufactured by Showa Denko K.K.) | 40 parts by mass |
| Crosslink agent (Diak No. 1 (hexamethylene diamine carbamate), manufactured by DuPont Dow Elastomers Japan) | 0.6 parts by mass |
| Crosslink agent (VULCOFAC ACT55 (70% by mass of a salt of 1,8-diazabicyclo(5,4,0)undec-7-ene and dibasic acid, 30% by mass of amorphous silica), manufactured by Safic-Alcan) | 0.6 parts by mass |
| Nitrile rubber (rubber copolymer of acrylonitrile and butadiene)(Nipol 1042 manufactured by ZEON CORPORATION) | 10 parts by mass |
| Sulfur (200-mesh sulfur, Tsurumi Chemical Co., Ltd.) | 0.1 parts by mass |
| Zinc oxide (secondary (graded in accordance with JIS) zinc white, manufactured by Seido Chemical Industries Co., Ltd.) | 0.3 parts by mass |
| Vulcanization accelerator (Nocceller CZ, manufactured by Ouchi Shinko Chemical Industrial Co., Ltd.) | 0.1 parts by mass |
| Electric conductive agent (QAP-01 (tetrabutylammonium perchlorate), manufactured by Japan Carlit Co., Ltd.) | 0.3 parts by mass |

Next, the thus obtained rubber composition was dissolved in an organic solvent (methyl isobutyl ketone, MIBk) to thereby prepare a rubber solution having a solid content of 35% by mass. While rotating the cylindrical support on which the polyimide base layer had been produced, the prepared rubber solution was spirally applied onto the polyimide base layer by continuously ejecting the rubber solution from a nozzle and moving the nozzle along the axial direction of the support.

The coating amount was controlled to an amount with which a final thickness of the center portion of the belt became 500 μm, both edges of the belt was designed to be 450 μm by changing the ejection amount in the course of the application. Thereafter, the cylindrical support on which the rubber coating solution had been coated was introduced into a hot air circulating dryer white keep rotating the cylindrical support. The temperature was increased to 90° C. at the rating rate of 4° C./min. and heated at 90° C. for 30 minutes.

Thereafter, the resultant was taken out from the dryer and was cooled. In accordance with the method illustrated in FIG. 4, as spherical particles, silicone spherical particles (TOSPEARL 120 (volume average particle diameter of 2.0 μm), manufactured by Momentive Performance Materials Inc.) were evenly spread over a surface of the cooled rubber coating (an elastic layer), and a pressing member, which was a polyurethane blade, was pressed against the surface of the elastic layer at pressing force of 100 mN/cm, to thereby fix the spherical particles in the elastic layer.

Subsequently, the resultant was again introduced into a hot air circulating dryer, and subjected to a heat treatment for 60 minutes by heating to 170° C. at the heating rate of 4° C./min, to thereby obtain Intermediate Transfer Belt A. Intermediate Transfer Belt A had the center thickness (C) of 560 μm, and edge thicknesses (F) and (R) of both 510 μm. The embedding rate of the spherical particles was 60%.

Example 2

Intermediate Transfer Belt B having a center thickness (C) of 560 μm, edge thicknesses (F) and (R) of 360 μm was obtained in the same manner as in Example 1, provided that the thickness was changed during the production of the elastic layer by changing the ejection amount from the nozzle.

Example 3

Intermediate Transfer Belt C having a center thickness (C) of 360 μm, edge thicknesses (F) and (R) of 330 μm was obtained in the same manner as in Example 1, provided that the thickness was changed during the production of the elastic layer by changing the ejection amount from the nozzle.

Example 4

Intermediate Transfer Belt D having a center thickness (C) of 560 μm, and edge thicknesses (F) and (R) of 510 μm was obtained in the same manner as in Example 1, provided that the silicone spherical particles were replaced with acryl spherical particles (product name: Tecpolymer MBX-SS, manufactured by SEKISUI PLASTICS CO., Ltd. (volume average particle diameter of 1.0 μm)).

Example 5

The rubber composition used in Example 1 was changed to the following materials, and the resulting mixture was kneaded to thereby produce a rubber composition.

| | |
|---|---|
| Hydrogenated nitrile rubber (Zetpol 2020L, ZEON CORPORATION) | 100 parts by mass |
| Stearic acid (beads stearic acid Tsubaki, NOF Corporation) | 1 part by mass |
| Sulfur (200-mesh sulfur, Tsurumi Chemical Co., Ltd.) | 1 part by mass |
| Zinc oxide (secondary (graded in accordance with JIS) zinc white, manufactured by Seido Chemical Industries Co., Ltd.) | 5 parts by mass |
| Vulcanization accelerator (Nocceller ST, manufactured by Ouchi Shinko Chemical Industrial Co., Ltd.) | 0.5 parts by mass |
| Red phosphorous (Nova Excel 140F, Rinkagaku Kogyo Co., Ltd.) | 10 parts by mass |
| Aluminum hydroxide (HIGILITE H42M, manufactured by Showa Denko K.K.) | 40 parts by mass |

After forming the rubber composition, the same processes were carried out as in Example 1, to thereby obtain Intermediate Transfer Belt E having a center thickness (C), and edge thicknesses (F) and (R) of all 510 μm.

Example 6

Intermediate Transfer Belt F having a center thickness (C) of 760 μm, edge thicknesses (F) and (R) of 420 μm was obtained in the same manner as in Example 1, provided that the thickness was changed during the production of the elastic layer by changing the ejection amount from the nozzle.

Example 7

Intermediate Transfer Belt G having a center thickness (C) of 560 μm, and edge thicknesses (F) and (R) of 420 μm and 460 μm, respectively, was obtained in the same manner as in Example 1, provided that the thickness was changed during the production of the elastic layer by changing the ejection amount from the nozzle.

Comparative Example 1

Intermediate Transfer Belt H, thicknesses (F), (C), and (R) of which were all 560 μm was obtained in the same manner as in Example 1, provided that the ejection amount from the nozzle was not changed during the production of the elastic layer to thereby give an even thickness.

Comparative Example 2

Intermediate Transfer Belt I having a center thickness (C) of 460 μm, and edge thicknesses (F) and (R) of 560 μm was obtained in the same manner as in Example 1, provided that the thickness was changed during the production of the elastic layer by changing the ejection amount from the nozzle.

<Evaluation>

Intermediate Transfer Belts A to H of Examples and Comparative Examples above were each mounted in an image forming apparatus of FIG. 5. Image quality (toner transfer property of a blue solid image consisting of two colors, cyan and magenta) of images formed on paper whose surface had been processed to have irregularities (Lezac, 260 kg paper) was visually evaluated and judged by ranking. As for the judgments, A was very good, B was an acceptable level within practical use, C was low density in the recess parts on the paper, or insufficient because density unevenness was caused depending on the area, and D was unusable. Thereafter, 200,000 sheets of paper were continuously fed for printing, and evaluation of image quality and observation of the belt surface were performed every 100,000 sheets of printing. The results are presented in Table 2-2.

Example 8

The evaluation described above was performed in the same manner as in Example 1, provided that the paper whose surface had been processed to have irregularities (Lezac, 260 kg paper) was replaced with plain paper (Type 620, manufactured by Ricoh Company Limited). The results are presented in Tables 2-1 and 2-2.

TABLE 2-1

| | | Elastic layer | Spherical particles | Belt thickness (μm) | | |
|---|---|---|---|---|---|---|
| | Belt | Material | Material | C | F | R |
| Ex. 1 | A | Acrylic rubber | Silicone | 560 | 510 | 510 |
| Ex. 2 | B | Acrylic rubber | Silicone | 560 | 360 | 360 |
| Ex. 3 | C | Acrylic rubber | Silicone | 360 | 330 | 330 |
| Ex. 4 | D | Acrylic rubber | Acryl | 560 | 510 | 510 |
| Ex. 5 | E | Nitrile rubber | Silicone | 560 | 510 | 510 |
| Ex. 6 | F | Acrylic rubber | Silicone | 760 | 420 | 420 |
| Ex. 7 | G | Acrylic rubber | Silicone | 560 | 420 | 460 |
| Ex. 8 | A | Acrylic rubber | Silicone | 560 | 510 | 510 |
| Comp. Ex. 1 | H | Acrylic rubber | Silicone | 560 | 560 | 560 |
| Comp. Ex. 2 | I | Acrylic rubber | Silicone | 460 | 560 | 560 |

TABLE 2-2

| | Embedding rate | Edge curling amount | Image quality | | | |
|---|---|---|---|---|---|---|
| | (%) | (mm) | Initial | 100,000 | 200,000 | Note |
| Ex. 1 | 55 | 1.6 | A | A | A | |
| Ex. 2 | 55 | 0.7 | A | A | B | |
| Ex. 3 | 55 | 1.2 | B | B | B | |
| Ex. 4 | 66 | 1.8 | A | A | A | |
| Ex. 5 | 70 | 2.5 | A | A | B | |
| Ex. 6 | 85 | 3.8 | A | B | B | |
| Ex. 7 | 66 | 1.4 | A | A | A | |

TABLE 2-2-continued

| | Embedding rate | Edge curling amount | Image quality | | | |
|---|---|---|---|---|---|---|
| | (%) | (mm) | Initial | 100,000 | 200,000 | Note |
| Ex. 8 | 55 | 1.6 | A | A | A | |
| Comp. Ex. 1 | 55 | 4.3 | A | B | Running failure | Stopped after 140,000 |
| Comp. Ex. 2 | 55 | 5.5 | B | C | Running failure | Stopped after 110,000 |

In Table 2-1, "C" in the column for the belt thickness indicates the belt thickness for the center portion (C), "F" indicates the belt thickness for the edge portion (F), and "R" indicates the belt thickness for the edge portion (R).

As has seen from the result, the present invention can provide an intermediate transfer belt, which is excellent in transferring ability to a transfer medium having a surface irregularities, realizes high transfer ability regardless of types and surface configuration of a transfer medium, gives high image quality, and has high durability without causing running failure due to curing of edges thereof over a long period, and can provide an image forming apparatus using the intermediate transfer belt.

Embodiments of the present invention are, for example, as follows:

<1> A belt for an image forming apparatus, containing:

a base layer;

an elastic layer; and spherical particles, wherein the belt for an image forming apparatus is provided across a plurality of rollers of the image forming apparatus to rotate, wherein the belt for an image forming apparatus has a laminate structure where at least the base layer and the elastic layer are provided in this order, wherein the spherical particles are partially embedded in an exposed surface of the elastic layer, and wherein, relative to a width direction of the belt for an image forming apparatus, a thickness of an edge portion of the belt for an image forming apparatus is 50% to 95% of a thickness of a center portion of the belt for an image forming apparatus, and an edge curling amount of the belt is 4 mm or less.

<2> The belt for an image forming apparatus according to <1>, wherein the belt for an image forming apparatus is a seamless belt.

<3> The belt for an image forming apparatus according to any of <1> or <2>, wherein the belt for an image forming apparatus is an intermediate transfer belt configured to receive a toner image formed by developing a latent image formed on an image bearing member with a toner.

<4> The belt for an image forming apparatus according to any one of <1> to <3>, wherein the elastic layer has a thickness of 400 μm to 1,000 μm in the center portion thereof.

<5> The belt for an image forming apparatus according to any one of <1> to <4>, wherein the spherical particles are spherical silicone particles.

<6> The belt for an image forming apparatus according to any one of <1> to <5>, wherein the elastic layer contains an acrylic rubber.

<7> The belt for an image forming apparatus according to any one of <1> to <6>, wherein an embedding rate of the spherical particles to the exposed surface of the elastic layer is 51% to 90%.

<8> An image forming apparatus comprising:

an image bearing member configured to form a latent image thereon and to bear a toner image;

a developing unit configured to develop the latent image formed on the image bearing member with a toner;

an intermediate transfer belt to which the toner image developed by the developing unit is primary transferred; and a transfer unit configured to secondary transfer the toner image born on the intermediate transfer belt to a recording medium, wherein the intermediate transfer belt is the belt for an image forming apparatus, as defined in any one of <1> to <7>.

<9> The image forming apparatus according to <8>, wherein the image forming apparatus is a full-color image forming apparatus containing a plurality of the image bearing members provided tandemly, each of which has the developing unit for a corresponding color to constitute a full-color.

This application claims priority to Japanese application No. 2011-251383, filed on Nov. 17, 2011, and incorporated herein by reference.

What is claimed is:

1. A belt for an image forming apparatus, comprising: a base layer; an elastic layer; and spherical particles, wherein the belt for an image forming apparatus is provided across a plurality of rollers of the image forming apparatus to rotate, wherein the belt for an image forming apparatus has a laminate structure where at least the base layer and the elastic layer are provided in this order, wherein the spherical particles are partially embedded in an exposed surface of the elastic layer, wherein, relative to a width direction of the belt for an image forming apparatus, a thickness of an edge portion of the belt for an image forming apparatus is 50% to 95% of a thickness of a center portion of the belt for an image forming apparatus, and wherein an edge curling amount of the belt after 200,000 sheets of printing is performed is 4 mm or less.

2. The belt for an image forming apparatus according to claim 1, wherein the belt for an image forming apparatus is a seamless belt.

3. The belt for an image forming apparatus according to claim 1, wherein the belt for an image forming apparatus is an intermediate transfer belt configured to receive a toner image formed by developing a latent image formed on an image bearing member with a toner.

4. The belt for an image forming apparatus according to claim 1, wherein the elastic layer has a thickness of 400 μm to 1,000 μm in the center portion thereof.

5. The belt for an image forming apparatus according to claim 1, wherein the spherical particles are spherical silicone particles.

6. The belt for an image forming apparatus according to claim 1, wherein the elastic layer contains an acrylic rubber.

7. The belt for an image forming apparatus according to claim 1, wherein an embedding rate of the spherical particles to the exposed surface of the elastic layer is 51% to 90%.

8. An image forming apparatus comprising:

an image bearing member configured to form a latent image thereon and to bear a toner image;

a developing unit configured to develop the latent image formed on the image bearing member with a toner;

an intermediate transfer belt to which the toner image developed by the developing unit is primary transferred; and a transfer unit configured to secondary transfer the toner image bom on the intermediate transfer belt to a recording medium, wherein the intermediate transfer belt is the belt for an image forming apparatus, as defined in claim 1.

9. The image forming apparatus according to claim 8, wherein the image forming apparatus is a full-color image forming apparatus containing a plurality of the imoyo bearing members provided tandemly, each of which has the developing unit for a corresponding color to constitute a full-color.

* * * * *